US008317560B2

(12) United States Patent
Hartmann et al.

(10) Patent No.: US 8,317,560 B2
(45) Date of Patent: Nov. 27, 2012

(54) METHOD FOR PRODUCING A SPARK PLUG ELECTRODE

(75) Inventors: Detlef Hartmann, Bamberg (DE); Jochen Fischer, Bamberg (DE)

(73) Assignee: Robert Bosch GmbH, Stuttgart (DE)

( * ) Notice: Subject to any disclaimer, the term of this patent is extended or adjusted under 35 U.S.C. 154(b) by 25 days.

(21) Appl. No.: 12/930,328

(22) Filed: Jan. 3, 2011

(65) Prior Publication Data

US 2011/0177744 A1 Jul. 21, 2011

(30) Foreign Application Priority Data

Jan. 5, 2010 (DE) ..... 10 2010 000 689

(51) Int. Cl.
*H01T 21/00* (2006.01)

(52) U.S. Cl. ..... 445/7

(58) Field of Classification Search ..... 445/7
See application file for complete search history.

(56) References Cited

U.S. PATENT DOCUMENTS

| | | | | |
|---|---|---|---|---|
| 6,373,172 | B1 * | 4/2002 | Kanao et al. | 313/141 |
| 2005/0093413 | A1 * | 5/2005 | Downs et al. | 313/141 |
| 2005/0174025 | A1 * | 8/2005 | Okamoto | 313/143 |
| 2007/0103046 | A1 * | 5/2007 | Tinwell | 313/143 |

FOREIGN PATENT DOCUMENTS

EP 0 269 267 6/1988

* cited by examiner

*Primary Examiner* — Anne Hines
(74) *Attorney, Agent, or Firm* — Kenyon & Kenyon LLP

(57) ABSTRACT

A method for producing a spark plug is provided, which includes a ground electrode fixed to a housing, and a center electrode insulated electrically from the housing by an insulator, the ground electrode having a ground electrode base and a ground electrode section, which ground electrode section including an electrode base and a noble metal section. In order to produce the spark plug, the ground electrode base is connected to the ground electrode section, in which, in a first step, the electrode base is connected to the noble metal section to form the ground electrode section, and in a second step, the ground electrode section is connected to the ground electrode base.

11 Claims, 3 Drawing Sheets

METHOD FOR PRODUCING A SPARK PLUG ELECTRODE

BACKGROUND OF THE INVENTION

1. Field of the Invention

The present invention relates to a method for producing a spark plug.

2. Description of the Related Art

Such a spark plug is known, for example, from published European patent document EP 0 269 267 B1. The spark plug has a housing on which a ground electrode is fixed. In the housing, there is an insulator having a longitudinal bore in which a center electrode is situated. By the application of a high voltage, a spark gap extends between the center electrode and the ground electrode. Based on the increasing requirement for engine performance in combination with more fuel-efficient engines, there is a demand for improvement in ignitability of spark plugs. It is known that spark plugs have been proposed, for this purpose, in which a first noble metal pin is connected to the area of an end face of a ground electrode and a second noble metal pin is connected to the end face of a center electrode. The two noble metal pins are opposite to each other, that is, the axes of symmetry of the two noble metal pins are situated on one line.

The welding seam is located on the circumference of the boundary layer between the noble metal pin and the end face of the ground electrode, and, in the most favorable case, it extends over the entire circumference (360°) of the interface.

The first disadvantage of the usual production method is that a costly welding process is required on the mounted spark plug in order to ensure the accurate covering of both the noble metal pins. A further disadvantage results from the sequence of the known method steps. Since the ground electrode is already connected to the housing of the spark plug before the noble metal pin is connected to the end face of the ground electrode, an encircling welded joint between the ground electrode and the noble metal pin cannot be reliably achieved, since the full circumference is not available for the welding process.

BRIEF SUMMARY OF THE INVENTION

The method according to the present invention has the advantage that the two opposite noble metal sections of center electrode and ground electrode are able to be aligned precisely, so that their axes of symmetry are situated on one line.

For this purpose, it is provided that, in a first step, the electrode base is connected to the noble metal section to form the ground electrode section, and, in a second step, this ground electrode section is connected to the ground electrode base to form the ground electrode. In this way, one is able to ensure the precise alignment of the opposite noble metal sections of center electrode and ground electrode in such a way that their axes of symmetry are situated on one line. Because of the resulting exact covering of the two noble metal sections, the optimal ignition conditions are obtained.

In a first exemplary embodiment, the ground electrode base is connected to the housing of the spark plug, and then the ground electrode section is connected to the ground electrode base. Since the ground electrode base is first connected to the housing and then the ground electrode section is fixed to the ground electrode base, the alignment of the ground electrode section with respect to the alignment of the center electrode is able to be accomplished. In this context, the axis of symmetry of the center electrode, which has a noble metal section, is used as a reference.

A bore is advantageously able to be applied to the ground electrode element in such a way that the longitudinal axis of the bore coincides with the longitudinal axis of the center electrode. The position at which the bore is applied to the ground electrode element may be ascertained via imaging methods, for example. Thereby the ground electrode section may be fitted into the ground electrode base so that the noble metal section of the center electrode and the noble metal section of the ground electrode base are positioned to be opposite each other, and their axes of symmetry are situated on one line.

In another exemplary embodiment, the ground electrode section is connected to the ground electrode base before the ground electrode base is fastened to the housing of the spark plug. In this context, a bore is again inserted into the ground electrode base in such a way that its longitudinal axis runs along the longitudinal axis of the center electrode, after the mounting of the ground electrode on the housing of the spark plug.

A continuous laser welding process is advantageously used in the method for connecting both the noble metal section to the electrode base to form the ground electrode section, and the ground electrode section to the ground electrode base. As opposed to a laser working in a pulsed manner, known from the related art, this has the advantage that unevennesses in the surface are lessened, and within the completely, or at least partially molten zone, cracks, pores, shrinkage faults and fluctuations in the respective alloy proportions, which all weaken the connection of noble metal/electrode material, are clearly reduced. Consequently, using this laser welding process, the service life of the component in operation is able to be increased.

The method for connecting the noble metal section to the electrode base is advantageously carried out in such a way that the welding determinative for the fatigue strength of the connection, between noble metal section and ground electrode, takes place uninterrupted, over the complete circumference (360°). In this way, the noble metal section may be connected to the electrode element to form the ground electrode section in such a way that the resulting welding seam is located on the circumference of the interface between the noble metal section and the end face of the electrode base, and extends uninterrupted over the complete circumference. Since, in particular, welded joints of Ni-based alloys and Ir, Pt alloys are critical with respect to incompletely realized fusing ranges, based on greatly different coefficients of thermal expansion, a clear improvement in the fatigue strength is achieved by the uninterrupted connection that extends over the entire circumference.

The geometrical execution of the electrode base advantageously provides the form of a cone from place to place, which, below the tip of the cone, has a circular conic section in such a way that the noble metal section covers the area of the conic section. The cone particularly advantageously has a cone angle in the range of 60° to 180°, preferably 160°. Because of this special shape, spark formation takes place preferably between the noble metal sections of the ground and the center electrode, since the heating of the electrodes by the sparks is reduced by the conical shape, and thus the greatest part possible of the spark energy is available for the ignition process.

DETAILED DESCRIPTION OF THE INVENTION

Figure 1:
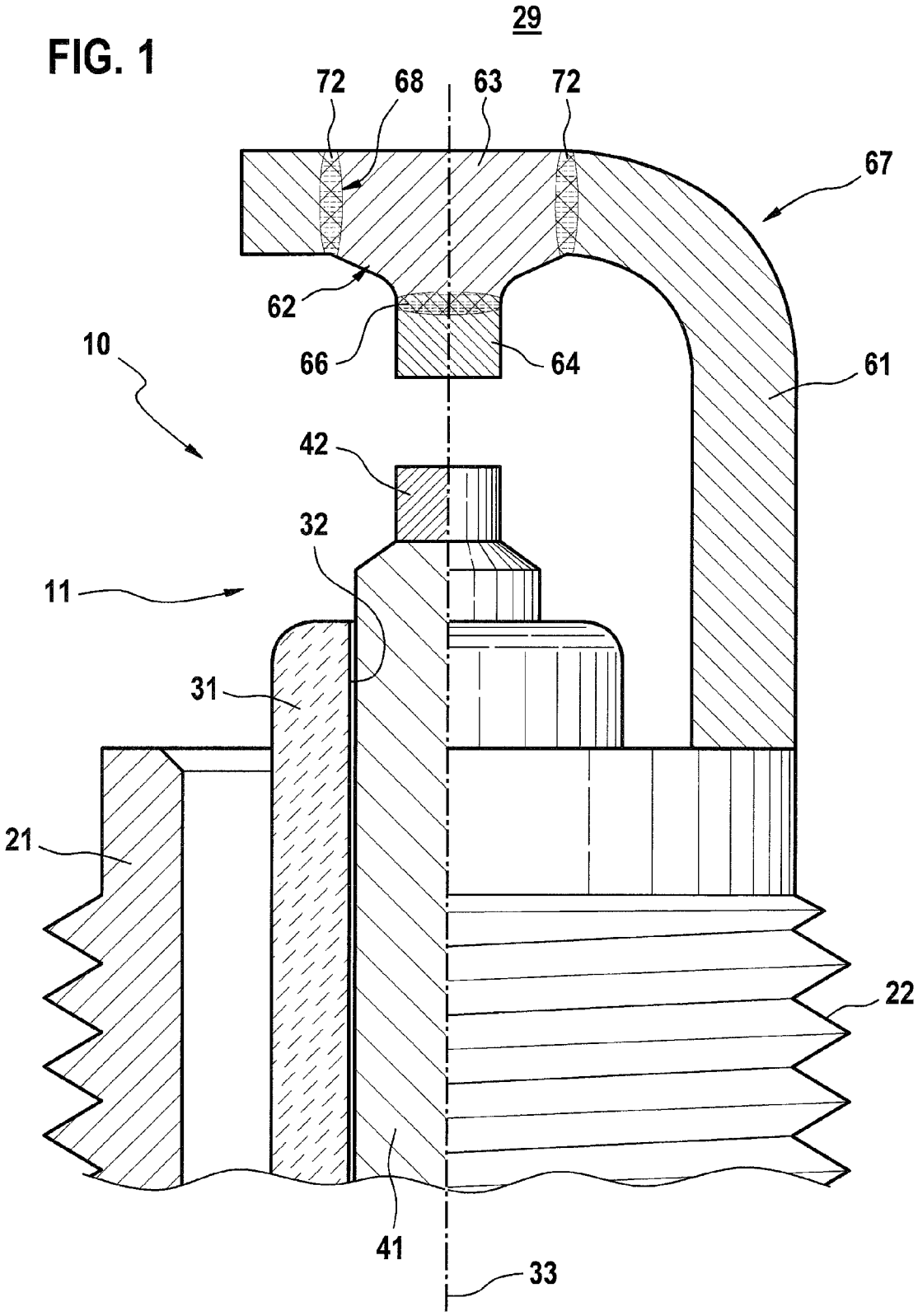
FIG. 1 shows a section of a spark plug on the combustion chamber end.

As the first exemplary embodiment of the present invention, FIG. 1 shows a section of a spark plug 10 on the combustion chamber end produced by the method of the present invention, having an end 11 on the combustion chamber side. Spark plug 10 includes a metallic housing 21, that is provided with a screw thread 22. Spark plug 10 is screwed into a mating thread in the cylinder head of an internal combustion engine, so that spark plug 10 projects with its end 11, that is on combustion chamber end, into a combustion chamber 29 of a cylinder of the internal combustion engine.

A ceramic insulator 31 is fixed gas-tight in housing 21. Insulator 31 has a longitudinal bore 32 having an axis of symmetry which forms longitudinal axis 33 of insulator 31, and therewith of spark plug 10. In longitudinal bore 32 of insulator 31, at the combustion chamber end, a center electrode 41 is inserted, which on its end face has a noble metal section 42. At combustion chamber end 11 of spark plug 10, insulator 31 extends out of housing 21. Center electrode 41 extends out over the end face of insulator 31 and into combustion chamber 29.

A ground electrode 67 is fixed to housing 21. Ground electrode 67 is formed as a so-called top electrode which, starting from housing 21, first extends in a direction parallel to longitudinal axis 33 of spark plug 10 and bends 90 degrees towards center electrode 41 so that ground electrode 67 extends past center electrode 41, that is, right into the region of longitudinal axis 33 of spark plug 10 (spark air plug). Ground electrode 67 has a ground electrode base, into which a bore 68 has been inserted. In the bore, a ground electrode section 62 is inserted, which is made up of an electrode base 63 and a noble metal section 64, and which are connected to each other via welding seam 66.

Figure 2:
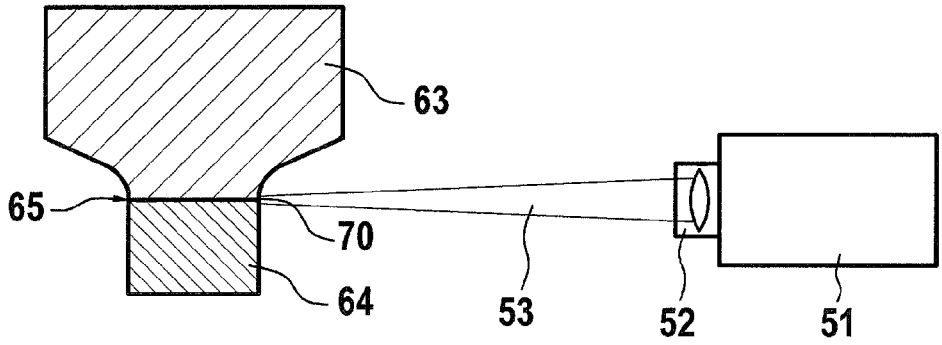
FIG. 2 shows a method step of producing the ground electrode section.

FIG. 2 shows a first method step for producing spark plug 10 shown in FIG. 1. Using a laser 51 and an optical system 52, a laser beam 53 is directed at the circumference of interface 65 between noble metal section 64 and electrode base 63. Laser 51 is operated continuously, that is, is operated in continuous wave mode (cw). In the area of a laser spot 70, laser beam 53 hits the circumference of interface 65 between noble metal section 64 and electrode base 63, and thus effects a heat input, which leads to the melting of noble metal section 64 and electrode base 63 in the vicinity of their interface 65.

Figure 3:
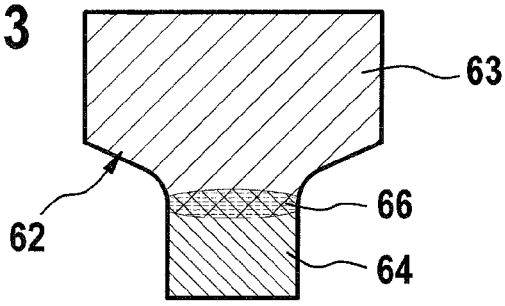
FIG. 3 shows the ground electrode section resulting after a welding process.

FIG. 3 shows ground electrode section 62, which has been created by welding together electrode base 63 and noble metal section 64. The resulting first welded joint 66 is located at the circumference of the interface between noble metal section 64 and the end face of electrode base 63, and extends over the complete circumference.

Figure 4:
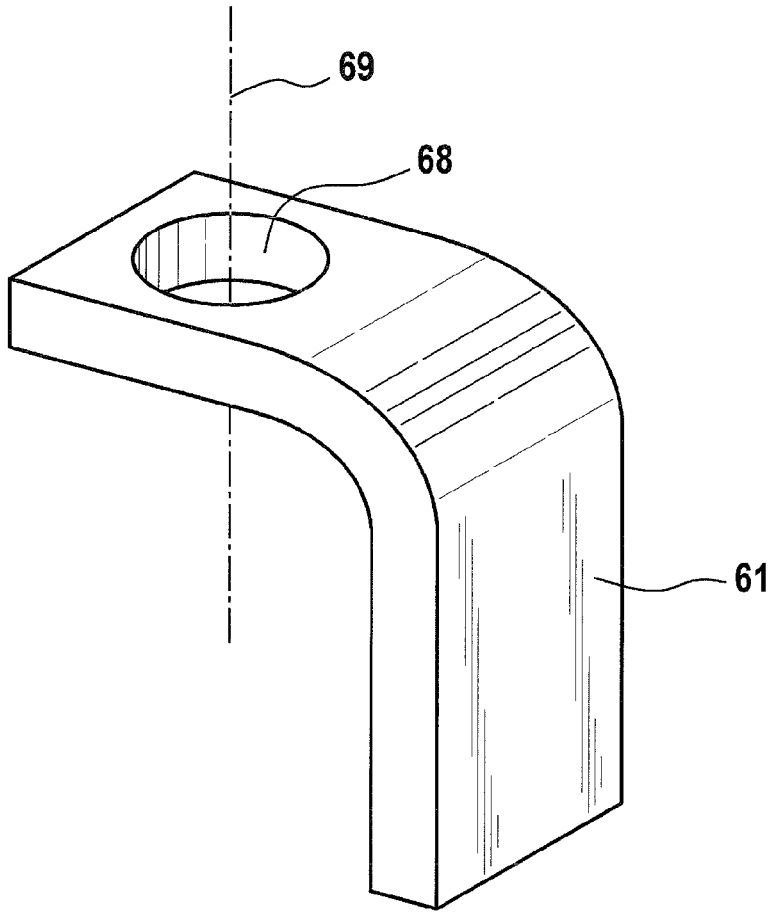
FIG. 4 shows an example embodiment of a ground electrode base.

FIG. 4 shows ground electrode base 61, which has a bore in it having a longitudinal axis 69.

Figure 5:
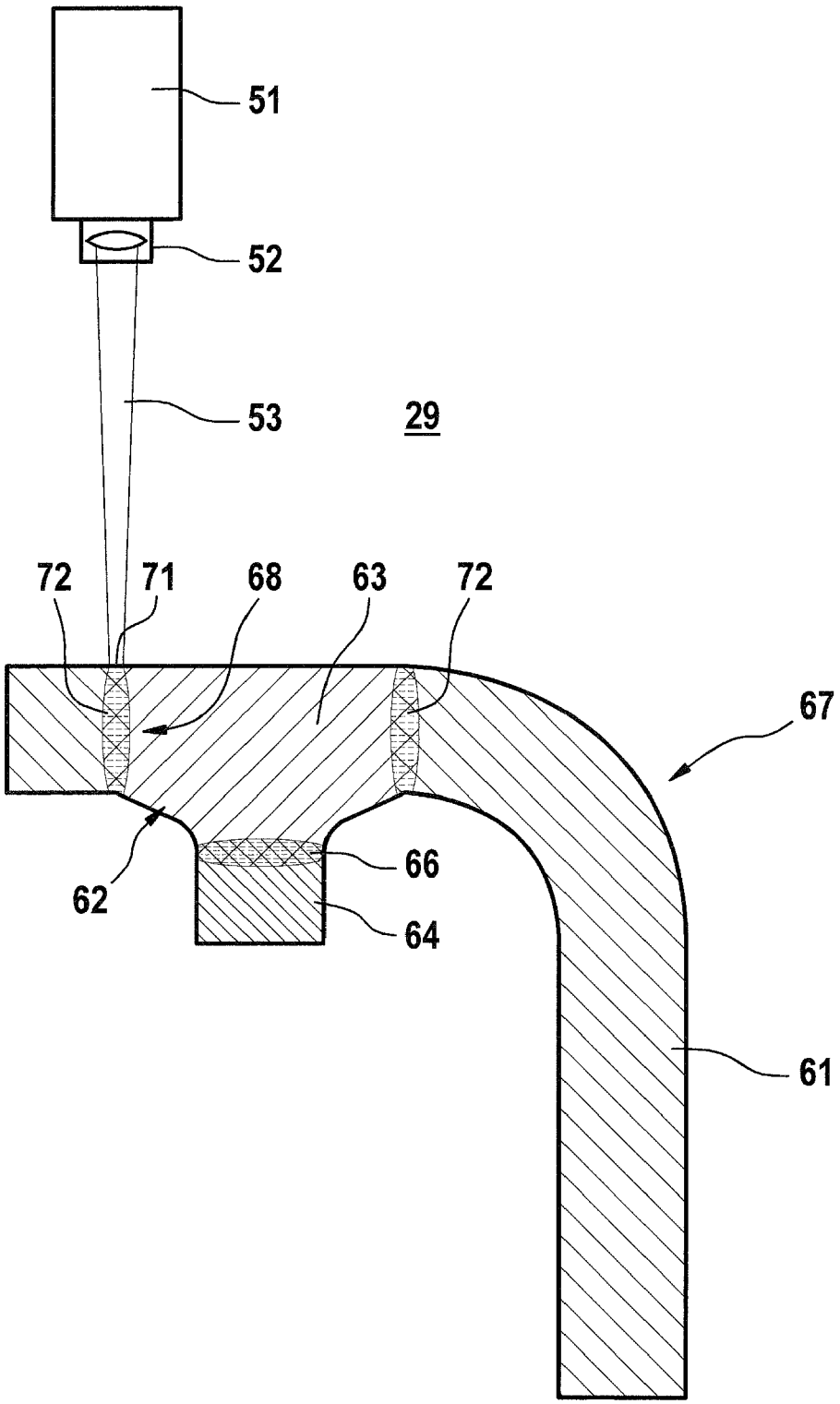
FIG. 5 shows the method step for connecting the ground electrode section to the ground electrode base to form the ground electrode.

FIG. 5 shows a second method step, in which ground electrode section 62 is inserted into bore 68 of the ground electrode base, and is connected to it. Using a laser 51 and an optical system 52, a laser beam 53 hits the surface of ground electrode base 61 facing combustion chamber 29, especially the edge of bore 68 of ground electrode base 61. A heat input in the area of laser spot 71 is effected by laser beam 53, both in ground electrode base 61 and in ground electrode section 62, which leads to the melting of ground electrode base 61 and ground electrode section 62 in the area of the entire interface between the two, from which a second welding joint 72 results. Ground electrode 67 is created from the fusion of the two.

What is claimed is:

1. A method for producing a spark plug, comprising:

providing a housing;

providing a center electrode insulated electrically from the housing by an insulator;

providing a ground electrode unit separate from the housing, wherein the ground electrode unit includes a ground electrode base and a ground electrode subsection, and wherein the ground electrode subsection includes an electrode base and a noble metal section, and wherein, in a first step in providing the ground electrode unit, the electrode base is connected to the noble metal section to form the ground electrode subsection, and in a second step in providing the ground electrode unit, the ground electrode subsection is connected to the ground electrode base; and connecting the ground electrode unit to the housing.

2. The method as recited in claim 1, wherein the ground electrode unit is a top electrode.

3. The method as recited in claim 2, wherein the ground electrode unit is mounted on the housing after the ground electrode subsection has been fastened to the ground electrode base.

4. The method as recited in claim 3, wherein a bore is inserted into the ground electrode base in such a way that the longitudinal axis of the bore, after the mounting of the ground electrode unit on the housing, extends along the longitudinal axis of the center electrode.

5. The method as recited in claim 4, wherein the noble metal section is mounted on the electrode base by a continuous laser welding process.

6. The method as recited in claim 1, wherein the ground electrode base is connected to the housing before the ground electrode subsection is fastened to the ground electrode base.

7. The method as recited in claim 6, wherein a bore is inserted into the ground electrode base, the longitudinal axis of the bore coinciding with the longitudinal axis of the center electrode.

8. The method as recited in claim 7, wherein the ground electrode subsection is inserted into the bore of the ground electrode base in such a way that the noble metal section faces the center electrode and is located on the longitudinal axis of the center electrode.

9. The method as recited in claim 8, wherein the noble metal section is laid onto an end face of the electrode base and is welded together with the electrode base along the circumference of the interface between the noble metal section and the electrode base.

10. The method as recited in claim 9, wherein at least one portion of the electrode base has the shape of a cone.

11. The method as recited in claim 10, wherein the cone has a cone angle in the range of 60° to 180°.

* * * * *